United States Patent [19]

Stoeckmann et al.

[11] Patent Number: 4,892,257

[45] Date of Patent: Jan. 9, 1990

[54] CONE CRUSHER COMPRISING ECCENTRICALLY DRIVEN CRUSHING CONE AND A MEANS FOR PREVENTING THE ENTRAINMENT OF THE CRUSHING CONE DURING NO-LOAD OPERATION

[75] Inventors: Helmut Stoeckmann, Wesseling; Klaus Schuette; Franz-Rudolf Schmitz, both of Cologne, all of Fed. Rep. of Germany

[73] Assignee: Klockner-Humboldt-Deutz Aktiengesellschaft, Fed. Rep. of Germany

[21] Appl. No.: 284,919

[22] Filed: Dec. 15, 1988

[30] Foreign Application Priority Data

Dec. 15, 1987 [DE] Fed. Rep. of Germany ..... 3742460

[51] Int. Cl.[4] ..... B02C 2/04

[52] U.S. Cl. ..... 241/32; 241/208; 241/215

[58] Field of Search ..... 241/32, 208, 214, 215, 241/286; 74/665 R, 665 B, 665 G, 665 C

[56] References Cited

U.S. PATENT DOCUMENTS

| | | | |
|---|---|---|---|
| 3,887,143 | 6/1975 | Gilbert et al. | 241/215 |
| 4,206,881 | 6/1980 | Werginz | 241/207 |
| 4,467,971 | 8/1984 | Schuman | 241/215 |
| 4,589,600 | 5/1986 | Schuman | 241/215 |

*Primary Examiner*—Timothy V. Eley

*Attorney, Agent, or Firm*—Hill, Van Santen, Steadman & Simpson

[57] ABSTRACT

An improved cone crusher with an eccentrically driven crushing cone, crushing jacket outside of the cone defining a crushing nip therebetween, the cone is driven in an oscillating manner tilting about its vertical axis and is connected to a driven through a universal joint having a one way clutch connected between the joint and a drive shaft with a support for the cone and a cap having a reduced portion which can shear in torsion, and means for holding the cone on a support with controllable force.

10 Claims, 1 Drawing Sheet

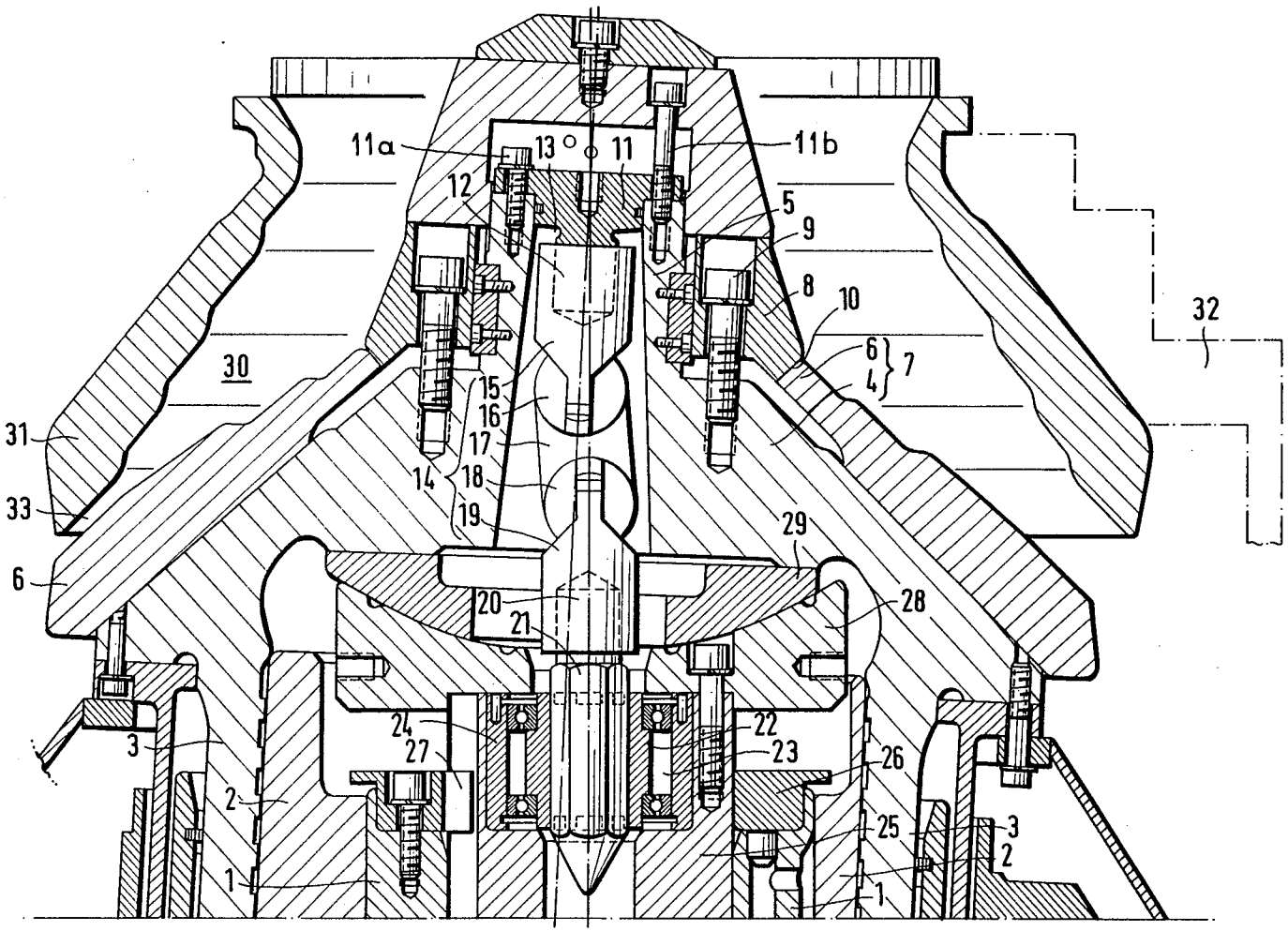
32
11b
5
9
8
10
6
4
7
11
13
12
11a
15
16
17
18
19
14
30
31
33
6
29
28
20
21
22
23
24
27
26
25
3
2
1

CONE CRUSHER COMPRISING ECCENTRICALLY DRIVEN CRUSHING CONE AND A MEANS FOR PREVENTING THE ENTRAINMENT OF THE CRUSHING CONE DURING NO-LOAD OPERATION

BACKGROUND OF THE INVENTION

The invention relates to a cone crusher, and more particularly to a means for preventing the entrainment of the crushing cone during no-load operation. A one way clutch is functionally inserted between the crushing cone and the stationary main shaft of the crusher, and is connected therebetween by a torsionally stiff, cardanic joint.

In conventional cone crushers, the problem of entrainment of the crushing cone exists, particularly with a cone crusher that is not charged or unfavorably charged. Different designs have therefore been proposed to prevent entrainment of the crushing cone consisting of a carrying cone and a crushing tool and thus to avoid an unfavorable comminution effect and also to avoid wear of the crushing cone.

German Patent No. 11 97 732 (Golucke et al U.S. Pat. No. 3,227,381, issued Jan. 4, 1966,) discloses a cone crusher wherein the support of the entrainment moment of the crushing cone results by means of a one way clutch and a following universal joint torsion shaft to the stationary, central main shaft of the crusher. The cardanic guide of the torsion shaft which is required because of the tumbling motion of the crushing cone relative to the crusher frame is resolved in that the torsion shaft is provided with toothed clutches at both of its ends. The tooth heads of these clutches are convexly arcuately shaped. The tooth heads form non-rotating cardanic articulations together with correspondingly toothed hubs, whereby the upper articulation is in rotational connection with the crushing cone upon interposition of the one way clutch and the lower articulation produces a torsionally rigid connection to the frame of the cone crusher by means of the central crusher shaft.

In this known embodiment for preventing entrainment of the crushing cone, a large number of structural parts are necessary in the transmission path of the supporting moment from the crushing cone to the main shaft of the crusher. In addition, accessibility to the one way clutch is necessary in the event of repair. Also, the manufacture of the torsion bar with its arcuate dentation at both ends involves relatively high costs. An easily accessible, cost-beneficial safety element that can be easily replaced in case of overload is also not available in the torque transmission chain.

The object of the invention is to considerably improve the known means for preventing entrainment of the crushing cone of a cone crusher.

A further object of the invention is to provide a unique cone crusher mechanism and improved drive therefor.

A further of the invention is to provide an improved cone crusher and drive wherein initial costs and maintenance costs are reduced as compared with drive mechanisms heretofore available.

FEATURES OF THE INVENTION

This structure and arrangement, particularly the use of a ball-jointed arm produces a short, direct moment between the carrying cone and the crusher frame. The upper region of the carrying cone can be compactly designed as a hollow carrying cone trunnion and the articulated shaft can be protected against overload and breakage with a separate break location. In addition, the employment of a balljointed shaft that can be commercially obtained leads to a noticeable saving of costs in comparison to prior solutions such as the solution disclosed by German Patent No. 11 97 732. Also deriving with the rated break location, articulated shaft and one way clutch, there is a considerable simplification of assembly in the event repairs are necessary.

Other objects, advantages and features will become more apparent with the teaching of the principles of the present invention in connection with the disclosure of the preferred embodiments thereof in the specification, claims and drawings, in which:

DESCRIPTION OF THE DRAWING

The single FIGURE of the drawings is a vertical sectional view taken through a cone crusher embodying the principles of the present invention.

DESCRIPTION OF THE PREFERRED EMBODIMENTS

As shown on the drawing, the drive system of the cone crusher comprises a stationary, vertical main shaft 1 that is surrounded by an eccentric bushing 2 which is connected to a rotary drive (not shown in detail) in the lower part of the cone crusher and whose inner and outer generated surfaces are equipped with sliding bearing material. The eccentric bushing 2 is guided in a lowfriction manner relative, first, to the main shaft 1 and second, to a carrying cone shaft 3 that surrounds the eccentric bushing 2.

The carrying cone shaft 3 is part of the carrying cone 4 that extends in an upward direction with a carrying cone trunnion 5 and that carries the crushing tool 6 on its conical surface. The carrying cone 4 and crushing tool 6 form the crushing cone 7. The crushing tool 6 is secured to the carrying cone 4 in a non-positive fashion in that a tension ring 8 is clamped against the top of the carrying cone 4 by cap bolts 9 pressing against the crushing tool 6 on an annular surface 10. A flanged cap 11 is secured to the carrying cone trunnion 5, by cap bolts and this flanged cap 11 is threaded into a cylindrical trunnion 12 at its lower end. The transition location comprises a constriction 13 in the diameter of the cap screw 11 that serves as overload safety for the ball-jointed shaft 14. The cap 11 is connected in a non-rotating fashion to an upper connecting member 15 of the articulated shaft 14 which provides a universal drive. A shear bolt **11*a* and another shear bolt 11*b* secure the cap non-rotatably to the carrying cone 4**.

The articulated shaft 14 consists of the upper connecting member 15, an upper ball 16, a middle section 17, a lower ball 18 and a lower connecting member 19.

The lower connecting member 19 of the articulated shaft 14 is connected to the trunnion 20 of a glide member 21. The glide member 21 has a polygonal profile which seats non-rotatably in a polygonal socket in a socket ring 22 of a one way clutch 23 in a manner which prevents turning but is axially displaceable. The outer ring 24 of this one way clutch 23 is in turn supported against a central piston 25 in a manner which prevents turning of the ring 24 relative to the piston 25. The piston 25 is axially movable inside the hollow-bored main shaft 1 and, in the lower part of the crusher, is supported against the column of a hydraulic oil system (not shown). The piston 25 is prevented from turning by a limiting ring 26 comprising a channel guide 27, and the limiting ring 26 is secured by a cap bolt to the upper end face of the stationary main shaft 1. The crushing cone 7 is supported by a spherical bearing resting on a spherical socket member 28 attached to the upper end side of the piston 25. The vertical position of the crushing cone 7 relative to the fixed frame portion of the cone crusher and crushing gap can be varied with the hydraulically movable piston 25. The pressure protection mechanisms, automatically protect the cone crusher from damage due to excessively high forces. Moreover, it serves the purpose of following the crushing cone 7 as a consequence of wear to the socket member 28 and the spherical bearing 29.

During operation of the cone crusher, the driven crushing cone 7 moves in a tumbling manner within a work space 30 that is formed by the crushing tool 6 and a crushing jacket 31 that is connected to the crusher frame by a supporting housing 32. As a consequence of the oscillating drive of the carrying cone 4 by the eccentric bushing 2, a crushing nip 33 is formed at the edge of the tool 6 and this nip is at the smallest distance between the crushing tool 6 and the crushing jacket 31, the position of this crushing nip rotating together with the rotation of the eccentric bushing 2, whereby the crushing tool 6 and, the carrying cone 4 roll off relative to the material situated in the crushing nip 33 as a consequence of friction. Compared to the rotational sense of the eccentric bushing 2, a backward rotation of the shaft of the carrying cone 4 relative to the main shaft 1 results. The one way clutch 23 is therefore constructed such that it enables a backward motion of the carrying cone 4.

When, by contrast, no material is situated in the working space 30, then the crushing tool 6 and, the carrying cone 4 encounter no tangential resistance in the crushing nip 33 and the common shaft of the crushing tool 6 and the carrying cone 4 exhibits the tendency to be entrained in the rotational sense of the eccentric bushing 2 as a consequence of tangential friction between the eccentric bushing 2 and the crushing cone shaft 3. This is prevented by the one way clutch 23 which inhibits in a rotational sense. It is thus assured that a faultless pressure comminution of the material in the crushing nip 33 ensues immediately when the working space 30 is charged with material to be crushed and that no wear-promoting friction can occur due to deceleration of the rotating crushing cone 7.

We claim:

1. A cone crusher comprising in combination:

an eccentrically driven crushing cone;

a stationary main shaft;

and a means for preventing the entrainment of the crushing cone given no-load operation in the form of a one way clutch that is functionally connected between the crushing cone and the stationary main shaft of the crusher via a torsionally stiff articulated shaft arranged between the crushing cone and the one way clutch and having multiple individual parts including an upper connecting part and a lower connecting part and a common middle part and a first universal joint between the upper and middle and a second universal joint between the middle and lower part.

2. A cone crusher according to claim 1:

characterized in that individual parts of the articulated shaft are releasably joined to one another.

3. A cone crusher according to claim 1:

including a carrying cone having a flange cap provided for the transmission of forces for non-rotational movement of the crushing cone, said cap being torsionally joined to the upper part of the articulated shaft.

4. A cone crusher according to claim 5:

including a connecting trunnion between the carrying cone and the articulated shaft, said connecting trunnion being secured in a bore of the upper connecting part of the articulated shaft and being secured against rotation and removal by at least one shearing pin.

5. A cone crusher according to claim 4:

characterized in that the connecting trunnion is fashioned as security against fracture and includes a constriction for the protection of the articulated shaft against overload.

6. A cone crusher according to claim 4:

characterized in that a lower connecting member of the articulated shaft is connected non-rotatably to the trunnion of a glide member by a polygonal profile seating in a polygonal socket in the glide member permitting relative axial movement between the connecting member and the glide member.

7. A cone crusher according to claim 6:

characterized in that the glide member is connected to the lower part of the articulated shaft through the one way clutch.

8. A cone crusher comprising in combination:

an outer annular crushing jacket;

a crushing cone defining a frusto conical working space with the jacket for crushing material therein;

an oscillatory eccentric rotary drive sleeve connected to the cone for causing oscillation and movement of the cone relative to said jacket to crush material in the working space;

a non-rotatable shaft extending coaxially through the center of said sleeve;

and a non-rotatable articulated shaft connected between the non-rotatable shaft and the cone accommodating oscillatory movement of the cone and having an upper, lower and center part with upper and lower universal joints respectively connecting the upper to the center and the center to the lower parts.

9. A cone crusher constructed in accordance with claim 8:

including an axially slidable joint positioned between said non-rotatable shaft and the articulated shaft permitting axial adjustment of the cone relative to the crushing jacket.

10. A cone crusher constructed in accordance with claim 8:

including a shearable connection between the articulated shaft and the cone which is capable of failing in instances of overload in the working space.

* * * * *